US007066799B2

(12) United States Patent
Oussaada et al.

(10) Patent No.: US 7,066,799 B2
(45) Date of Patent: Jun. 27, 2006

(54) PROTECTION MASK FOR SURFACE TREATMENT OF TURBOMACHINE BLADES

(75) Inventors: Lhocine Oussaada, Taverny (FR); Thierry Labrousse, Beauchamp (FR); Thierry Belkheir, Montigny les Cormeilles (FR); Claude Colas, Meriel (FR); Habib Mehdaoui, Stains (FR); Christian Polis, Sannois (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/997,863

(22) Filed: Nov. 29, 2004

(65) Prior Publication Data

US 2005/0227589 A1 Oct. 13, 2005

(30) Foreign Application Priority Data

Dec. 4, 2003 (FR) ..... 03 14256

(51) Int. Cl.
*B24B 19/00* (2006.01)

(52) U.S. Cl. ..... 451/439; 427/252; 415/419

(58) Field of Classification Search ..... 451/439, 451/29, 31; 427/282, 444; 118/721
See application file for complete search history.

(56) References Cited

U.S. PATENT DOCUMENTS

| | | | | |
|---|---|---|---|---|
| 3,482,423 | A | 12/1969 | Murray et al. | |
| 4,530,861 | A * | 7/1985 | Sippel et al. | 427/444 |
| 5,565,035 | A * | 10/1996 | Sylvestro et al. | 118/721 |
| 6,037,004 | A * | 3/2000 | Zajchowski et al. | 427/282 |
| 6,189,356 | B1 * | 2/2001 | Simeone et al. | 72/53 |
| 6,273,676 | B1 * | 8/2001 | Brooks et al. | 415/191 |
| 6,403,157 | B1 * | 6/2002 | Ireland et al. | 427/282 |
| 6,419,753 | B1 * | 7/2002 | Wheat et al. | 118/721 |
| 6,645,299 | B1 * | 11/2003 | Brown | 118/505 |
| 6,776,854 | B1 * | 8/2004 | Bardelmeier et al. | 148/213 |
| 6,913,442 | B1 * | 7/2005 | Das et al. | 415/210.1 |
| 2003/0027495 | A1 * | 2/2003 | Shaw | 451/29 |

FOREIGN PATENT DOCUMENTS

EP 0 925 844 A2 6/1999

* cited by examiner

*Primary Examiner*—David B. Thomas
*Assistant Examiner*—Robert Scruggs
(74) *Attorney, Agent, or Firm*—Oblon, Spivak, McClelland, Maier & Neustadt, P.C.

(57) ABSTRACT

A protection mask used during surface treatment for a turbomachine blade, including for example a sand blasting step and/or a metal coating step, includes at least one part matching the shape of a portion of the blade. The mask is designed to resist surface treatment effects and to be placed on the surface to be protected, and can form a removable and reusable tool according to the invention.

24 Claims, 2 Drawing Sheets

PROTECTION MASK FOR SURFACE TREATMENT OF TURBOMACHINE BLADES

The invention relates to surface protection of turbomachine blades before a partial surface treatment that is abrasive or is simply not appropriate for surfaces that are not be treated. It also relates to the application of a surface protection for any mechanical part to be subjected to a similar surface treatment.

With reference to FIG. 1, a turbomachine blade 10, in this case in a compressor or a turboject fan, is composed of an airfoil 11 comprising an intrados face and an extrados face 19, a stem 12 and a root 13 fitting into an axial compartment formed in the disk of the machine supporting it (not shown). A platform 14 separates the airfoil 11 from the stem 12.

The disk thus supports a number of blades, in which the airfoils are all kept equidistant from each other particularly by fins 15 located on a median part of each face of the airfoils, and in which the ends of two adjacent fins of two adjacent airfoils are in contact.

Surface treatment of the blade 10, usually made of titanium or a titanium alloy, comprises a first surface treatment E1 by sand blasting to increase the roughness in preparation for a second so-called metal coating step E2 with deposition by thermal spraying. This is the case particularly for spraying either a copper alloy, for example Cu- Ni- In (copper-nickel-indium), using a plasma torch, the ductility of the alloy being such that the motor vibrations during operation are damped at the contacts between the blades and the disk, or a tungsten carbide alloy, for example WC-Co (tungsten carbide-cobalt), which is sufficiently hard to prevent wear caused by friction between adjacent fins.

The plasma torch sprays the alloy coating at high speed and at high temperature (more than 2 500° K.) onto the surface to be treated to make it bond.

Steps E1 are very abrasive and steps E2 are undersirable except on the surfaces to be treated. For the treatment of fins, they require that a protection should be inserted between the sand blasting tools and/or the plasma torches and the faces 19 of the blades 10 to assure that the blades are not affected. More precisely, only the end surfaces 17 of the fins 15 intended to come into contact with the end surfaces 17 of the other fins of adjacent blades, are subject to the surface treatments defined above during manufacturing. Furthermore, the two faces 19 of the airfoil 11 are provided with spiral surfaces with a very precise geometry, that have to be protected.

For treatment of the root, only the contact surfaces 18 on each side 13 of the root of the blade 10 are to be coated. The other areas 12 and 13 of the root have to be protected at least during the treatment E2.

At the present time, to achieve this, the operator manually applies adhesive tape with a sufficient mechanical strength and thermal resistance around the surfaces to be treated.

These manual operations are long and tedious due to the complexity of blade shapes, the required precision and the lack of access to surfaces to be protected. They do not provide a constant quality since they are not perfectly repetitive and poor adhesion of adhesive tape introduces a risk of masking or even separation of the deposited coating. Furthermore, during metal coating, it is observed that particles reach the layer being formed after having bounced on the protection surface. The bond or the homogeneity quality of these particles is then insufficient, and the corresponding areas are not as resistant to stresses applied on turbomachines.

Therefore there is a need to improve the productivity and quality of these operations.

Furthermore, operators working on these operations are affected by nervous tension particularly due to the sustained attention necessary for their execution; they are also exposed to musculo-skeletal disorders (MSD) resulting from performing repetitive actions.

To overcome all these disadvantages, the applicant proposes a protection mask for surface treatment of surfaces of a turbomachine blade comprising a root and possibly fins, arranged around the said surfaces and resistant to the effects of the surface treatment, while forming a removable and reusable tool, characterized by the fact that since the said surfaces are located either on the root of the blade or at the end of the fin, it is composed of at least one part matching the shape of the root or the fins respectively, and comprising openings through which the said surfaces to be treated can be seen.

The surface treatment includes a sand blasting step and/or a metal coating step.

Tooling refers to a part or a set of parts that are at least partly rigid, for which the shape and materials are adapted to masking of parts of surfaces to be protected. The materials from which the tooling is made are also capable of resisting the operating environment of operations E1 and E2. Due to the tooling according to the invention, all manual applications of adhesive tape are eliminated and masking is perfectly repetitive.

Since step E2 causes a temperature increase, the protection mask is preferably arranged to resist the temperature effects of the surface treatment, in this case plasma torch spraying.

Also preferably, since step E2 requires a previous mechanical treatment, the protection mask in step E1 is made of a material resistant to the abrasive action of sand blasting.

Advantageously, the protection mask is made of stainless steel or a silicone material or a polymer material.

The mask may be used both for sand blasting and for plasma deposition, and may be reused for a series of turbomachine blades.

The invention will be better understood after reading the following description of a protection mask for two applications of the invention and the appended drawings, wherein.

Figure 1:
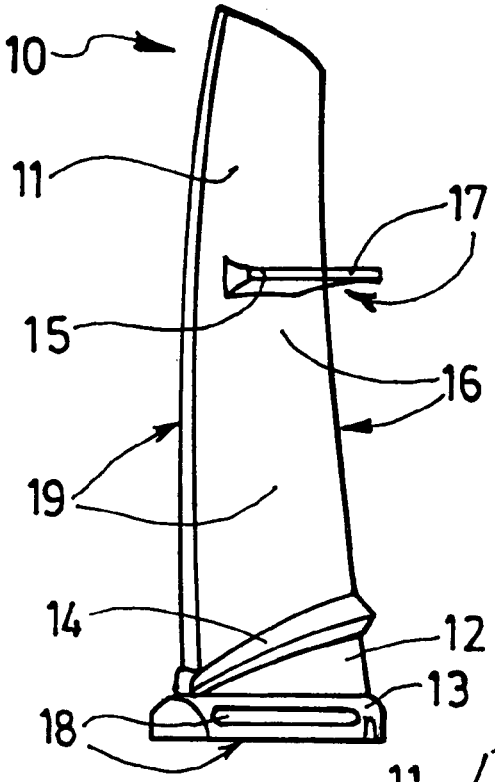
FIG. 1 shows a perspective view of a compressor blade.
Figure 4A:
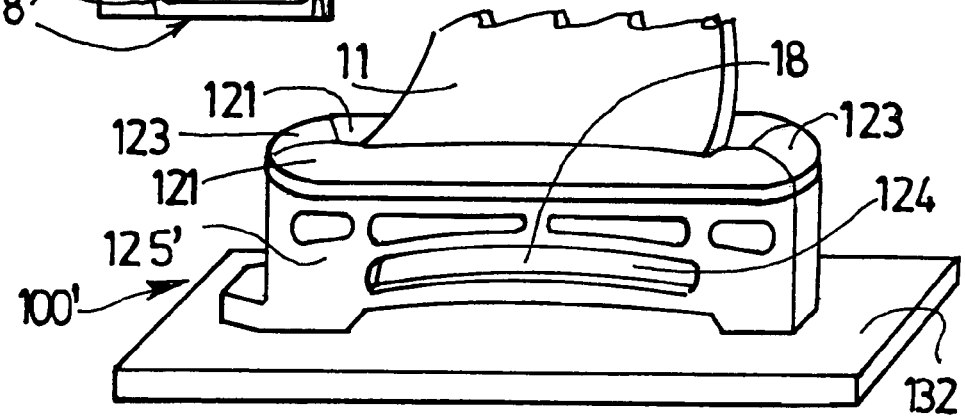
Figure 4B:
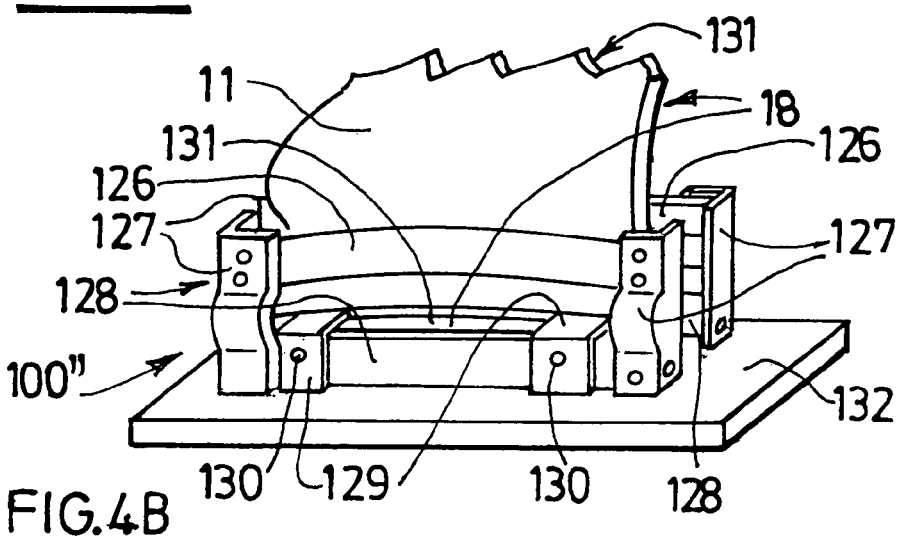
Figure 2:
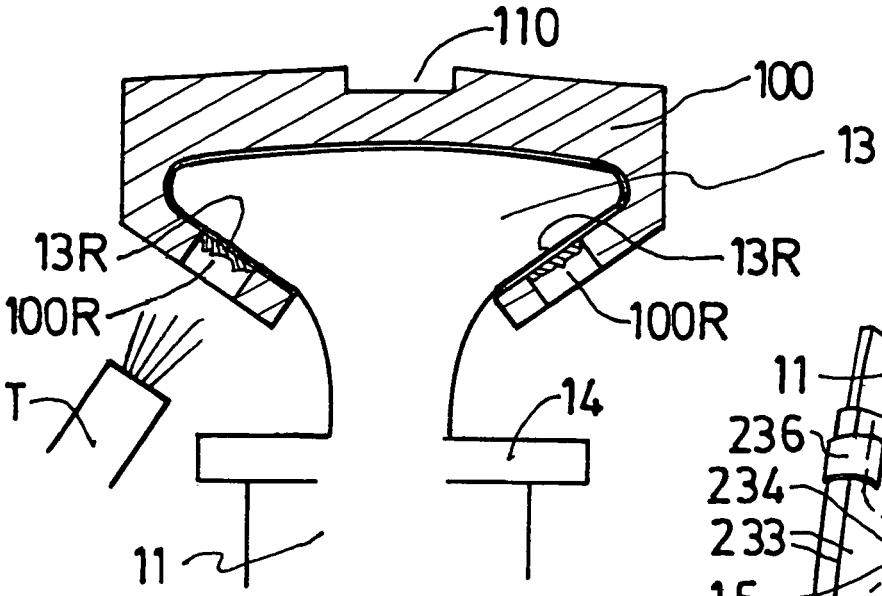
FIG. 2 shows a side view of a first application of the invention consisting of a mask shaped to enable treatment of the root of a blade.
Figure 5:
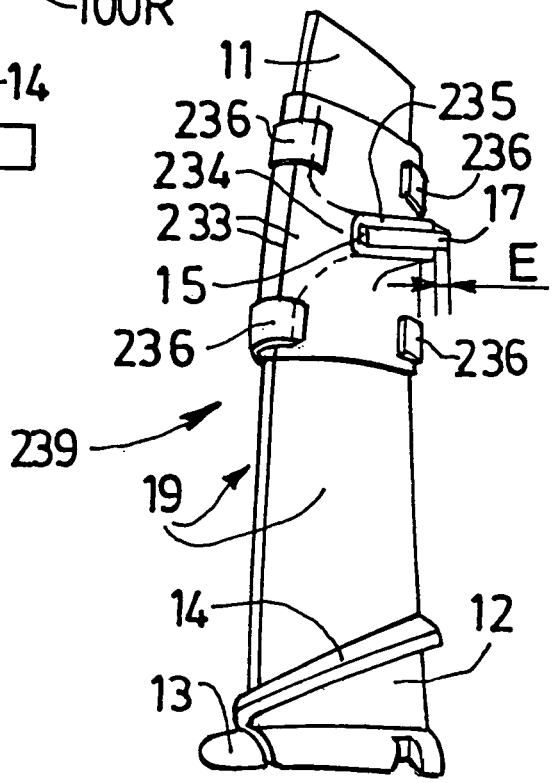

FIGS. 4A and 4B shows perspective views of another application of the invention, consisting of masks for the protection of surfaces of a blade against sand blasting and plasma deposition on surfaces of its root to be treated; and FIG. 5 shows a perspective view of a second application of the invention, consisting of a mask for the protection of surfaces of a blade against sand blasting and plasma deposition on surfaces of its fins to be treated;

FIG. 2 shows the lower part of a compressor blade, on which the airfoil 11, the platform 14 and the root 13 can be seen. In this case, the root has a dovetail shape and is straight (non-exhaustive case, mentioned as an example). In order to enable damping of vibrations of the blade within its compartment while the motor is in operation, a coating 13R is applied, located in zones that are in contact with the sides of the compartment. So that this coating can be applied with a plasma torch, a mask 100 according to the invention is arranged so that it partly matches the shape of the root of the blade, and can be put into place simply by force fitting. The mask 100 is advantageously made of stainless steel, and has a determined thickness. A window 100R is formed in this mask, on each side of the root. The shape and dimensions of the windows depend on the shape and dimensions of the coating 13R to be applied using the plasma torch. This coating 13R is located on the two surfaces of the root that will be in contact with the disk on the turbomachine.

Since the plasma torch T is preferably placed perpendicular to the surface to be treated, the walls of the window are also perpendicular to this surface. Molten metal particles pass through this window during the metal coating operation with the plasma torch. This arrangement has the advantage that molten metal particles output from the plasma torch that are not directed along the axis of the window are deposited on the mask in the area surrounding the window 100R without being reflected inwards. Therefore these particles will not rebound and disturb the layer being formed. After a layer of the required thickness has been applied, the mask is removed. The shape of the coating 13R is exactly the same as the shape defined by the window; therefore there is no need to perform a reworking operation.

The mask is used for the treatment of other blades if the metallized area surrounding the window is not too thick. The mask may thus be used several times before it needs to be reshaped by "demetallization" of the area surrounding the window. This type of mask restoration operation is advantageously done by chemical machining using techniques known to those skilled in the art:

If a previous surface preparation operation is necessary, the same mask is used to protect the surfaces that must not be sanded.

This type of mask also has the advantage that it enables treatment of several blades at the same time. To achieve this, a groove 110 is provided in the wall of the mask bottom so that an alignment bar 43 can subsequently be applied.

Figure 3:
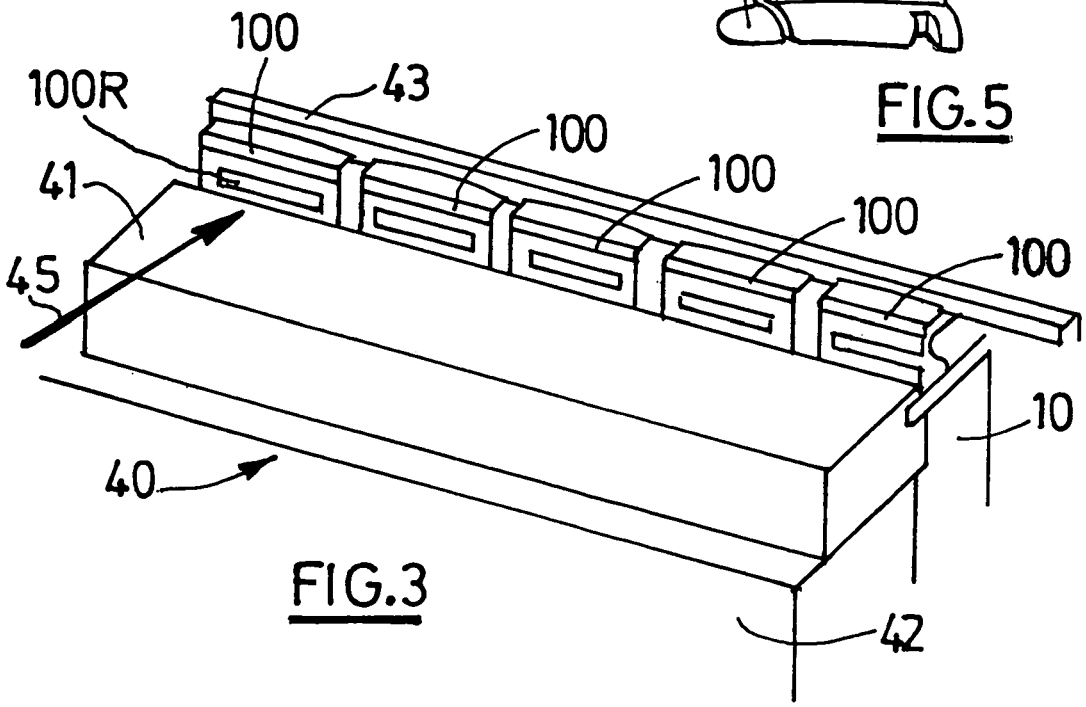
FIG. 3 shows an assembly enabling simultaneous treatment of several blades.

FIG. 3 shows an assembly for the treatment of several blades. The blades equipped with their protection mask 100 are assembled on a single tooling 40.

The tooling 40 comprises a frame 42 on which the blades are fixed, with the airfoil facing downwards, so that the masks are on top. The windows 100R are visible. A bar 43 connects the masks 100 through grooves 110. Due to this bar, masks can be aligned precisely with respect to each other. Side plates 41 are placed along the row of masks so as to overlap and protect the blade platforms. Once the assembly has been made, the treatment tool is placed in the direction of the first window and is displaced at a determined speed parallel to the windows. With this arrangement, the sand blasting treatment followed by metal coating, or metal coating alone, can be applied to a set of N blades with constant quality.

FIGS. 4A and 4B show a masking device adapted to blades with a curved root, such as large fan blades.

For a step E1 to sand the surfaces 18 of the root 13 of the airfoil 11 of a blade 10, a protection mask 100' is provided as shown in FIG. 4A, comprising a frame 125 made of a silicone material or a polymer material fixed onto a base 132, arranged so that it can be installed by inserting the root 13 of the airfoil 11 while allowing the surfaces 18 to be treated to appear through the holes 124.

To achieve this, the frame includes two half-shells 121 matching the shapes of the above surface, produced using the same drawings that were used for their manufacturing.

These two half-shells 121 are assembled by removable blots 123, for example that themselves nest into the two half-shells 121, and can therefore be disassembled so that they can be used for a new assembly and then reused for the treatment of another blade.

For a step E2 for plasma deposition on surfaces 18 of the root 13 of the airfoil 11, a protection mask 100" is provided as shown in FIG. 4B, comprising four supports 127 fixed on a base 132" and arranged to be able to support two stainless steel spacers 126 supporting the airfoil 11 and two stainless steel masks 128, holding and covering the root 13 of the airfoil 11 on each side of the root, while allowing the surfaces 18 to be treated to appear through the openings 131.

In this case, the periphery of the openings 131 is provided with tabs 129 delimiting the extent of the surface to be treated at will, so that this extent can be precisely adjusted. The tabs 129 can be adjusted by sliding them on the masks 128 and are held in place by clamping screws 130.

In the example in the figure, the tabs 129 only limit the length of the openings 131, but the same system could also be used in the width, the two devices easily being assembled simultaneously.

FIG. 5 shows an embodiment of the invention corresponding to treatment of blade fins. A protection mask 239 comprising two half-shells 233 matches the shape of the fins according to a duct 234 and adjacent faces 19 of these fins. These shapes are deduced directly from the drawing of the blade 10. The two half-shells 233 are assembled to each other on the surface to be protected by means of four clamps 236, for example stainless steel leaf springs embedded in holes (not shown in the figures) formed in the mask 239 for this purpose.

In this case the mask is made of a silicone material. This material is resistant to the mechanical sand blasting treatment and to the metal coating heat treatment.

The two half-shells 233 show the fin end surfaces 17 to be treated through openings 235 such that these ends remain exposed at a sufficient height "e" from the mask.

The mask 239 is used for sand blasting and for plasma deposition, and is reused a number of times.

This invention is not limited to the embodiments shown, it includes all variants available to those skilled in the art.

The invention claimed is:

1. A protection mask for surface treatment of surfaces of a turbomachine blade comprising a root wherein said surfaces are located on the root of the blade, said protection mask comprising:

at least one part matching a shape of the root, and openings having a same shape as a shape of said surfaces and wherein said surfaces to be treated can be seen through said openings when said at least one part is mounted on said root.

2. A mask according to claim 1, wherein said at least one part comprises at least two half-shells.

3. A mask according to claim 1, wherein said at least one part is made of a material resistant to thermal effects of a plasma deposition.

4. A mask according to claim 1, wherein said at least one part is made of a material resistant to thermal effects of sand blasting.

5. A mask according to claim 1, wherein said at least one part is made of stainless steel.

6. A mask according to claim 5, wherein said at least one part is configured to be mounted on said root of said blade by force fitting.

7. A mask according to claim 1, wherein said at least one part is made of a silicone.

8. A mask according to claim 2, wherein said at least two half-shells are held together by at least one of bolts and clamps.

9. A mask according to claim 2, wherein said at least two half-shells are made of stainless steel.

10. A mask according to claim 1, wherein said at least one part is made of a polymer material.

11. A mask according to claim 1, wherein said at least one part has a dovetail cross-section so as to fit over a root having a dovetail shape.

12. A mask according to claim 1, wherein said openings are defined by walls that are perpendicular to said surfaces.

13. A mask according to claim 1, wherein said at least one part defines a groove.

14. A mask according to claim 13, wherein said groove is located on a wall covering a bottom of said root.

15. A mask according to claim 1, wherein said at least one part is mounted on said root of said blade so that said openings expose said surfaces.

16. A mask according to claim 1, wherein said at least one part is resistant to effects of said surface treatment.

17. A mask according to claim 16, wherein said at least one part is removable from said blade after said surface treatment.

18. A mask according to claim 17, wherein said at least one part is reusable for treating surfaces of another blade.

19. A protection mask for surface treatment of a surface of a tubromachine blade comprising a fin, wherein said surface is located at an end of the fin, said protection mask comprising:

two half shells matching a shape of the fin and assembled with each other by clamps.

20. A mask according to claim 19, wherein said two half shells define a window that exposes said end of said fin when said two half shells are mounted on said turbomachine blade.

21. A mask according to claim 20, wherein said window is defined by walls that are perpendicular to said surface.

22. A mask according to claim 19, wherein said two half shells are resistant to effects of said surface treatment.

23. A mask according to claim 22, wherein said two half shells are removable from said turbomachine blade after said surface treatment.

24. A mask according to claim 23, wherein said two half shells are reusable for treating a surface of another turbomachine blade.

* * * * *